US005581956A

United States Patent [19]

Fennessy et al.

[11] Patent Number: 5,581,956

[45] Date of Patent: Dec. 10, 1996

[54] UNIVERSAL DECORATION MOUNTING ARRANGEMENT

[75] Inventors: Charles W. Fennessy, Lemont, Ill.; Ivan Liu; David A. Parshad, both of Ontario, Canada; Frank Lang, Warrenville, Ill.

[73] Assignee: Noma International, Inc., Forest Park, Ill.

[21] Appl. No.: 382,969

[22] Filed: Feb. 2, 1995

[51] Int. Cl.[6] ..... E04F 19/00

[52] U.S. Cl. ..... 52/28; 248/237; 362/145; 362/249; 362/396

[58] Field of Search ..... 52/28; 24/336, 24/339, 561, 562; 362/806, 249, 145; 248/237, 48.1

[56] References Cited

U.S. PATENT DOCUMENTS

| | | | |
|---|---|---|---|
| 990,856 | 5/1911 | Freiberg | 24/73 |
| 1,342,698 | 6/1920 | Stevens | 24/561 |
| 1,886,882 | 11/1932 | Huber | 24/561 X |
| 1,943,228 | 4/1933 | Pearson | 248/237 |
| 3,193,229 | 4/1963 | Stock | 24/339 X |
| 3,599,918 | 8/1971 | Patchett | 248/215 |
| 3,883,926 | 5/1975 | Reynolds | 24/73 |
| 4,901,212 | 2/1990 | Prickett | 362/145 |
| 4,905,131 | 2/1990 | Gary | 362/249 |

*Primary Examiner*—Michael Safavi
*Assistant Examiner*—Timothy B. Kang
*Attorney, Agent, or Firm*—Kirschstein, et al.

[57] ABSTRACT

An arrangement for mounting decorative lights on a variety of external building structures, including roof shingles, soffits, vinyl or metal gutters or the like, includes a mounting member having a support portion including at least one substantially cylindrical confining portion for receiving a portion of the respective decorative light. The mounting member further includes a mounting portion including a central portion extending substantially along the same plane as the support portion, and a pair of angled lateral portions flanking the central portion and extending out of the plane and back to it as considered in a direction away from the support portion. The central portion and the pair of lateral portions are operative for engaging oppositely facing surfaces of the respective building structure to at least frictionally detain the mounting member and, thus, the decorative light in place on the building structure. The lateral portions may be provided with teeth that either dig into the roof shingle or soffit, or engage behind a ledge or a rear protuberance of a gutter, depending on the type of structure on which the mounting arrangement is mounted. The central portion may include a serrated detent that projects out of the plane of the central portion towards the support portion and into engagement with either the roof shingle, or a front protuberance of a metal gutter.

15 Claims, 3 Drawing Sheets

UNIVERSAL DECORATION MOUNTING ARRANGEMENT

BACKGROUND OF THE INVENTION

1. Field of the Invention

The present invention relates to mounting arrangements in general, and more particularly to arrangements for temporarily attaching exterior miniature light sets or chains and similar holiday decorations to external structures or features of a one-or multi-family house, a similar dwelling, a building, or its appurtenance.

2. Description of the Related Art

There are already known various constructions of arrangements for attaching decorations, such as sets or chains of miniature holiday lights, to roofs, roof shingles, soffits, gutters and similar external structures or features of a house to give the latter the desired festive holiday look. Such arrangements start with something as simple as double hooks that engage around gutter rims and have the decorations suspended therefrom, or large-headed nails used to nail such decorations to the soffit, or to the roof structure through the roof shingles, and run the entire gamut to sophisticated brackets and the like that are specially designed for connecting such decorations to specific types of such structures, such as to vinyl gutters only, or to metal gutters only, or to soffits only, or to roof edges only, and so on.

Of course, the simplistic solutions, which have the appeal of being quite inexpensive, have their drawbacks, such as lack of assurance that the double-hook attachments will withstand the rigors of inclement weather, such as high winds, and keep the decorations in place, as well as their inherent inability to prevent the miniature lights from swaying. In the case of fasteners such as nails that perform their attaching action due to their penetration into or through the support structure, the resulting damage to such structure may cause the roof to leak or make the soffit or similar wood structure or member vulnerable to rotting or similar destructive action.

In contradistinction thereto, the more sophisticated attaching arrangements have the disadvantage that they are too specialized and that, consequently, they are not functionally interchangeable. This, of course, means that the prospective decorator will have to obtain different types of such attaching arrangements for use on different types of structures, such as specific gutters versus soffits etc. This brings about the dangers of miscalculating the number of the attaching arrangements of the various types that are to be obtained and falling short of one or the other type in the middle of the decorating job, thereby requiring an additional trip to the store, or of having to buy many more of the attaching arrangements than what would correspond to the number of requisite attachment points. Overpurchasing the arrangements is done not so much because the decorator wishes to have such excess in order to avoid the need for having to revisit the store, but rather because the attaching arrangements of each type usually come in packages each of which includes a fixed number of such arrangements. The likelihood is that the potential user will have to purchase unneeded mounting arrangements, increasing in proportion to the number of packages required to meet the minimum requirement for the mounting arrangements of each type and to the number of the various types of the mounting arrangement needed. This becomes quite an expensive proposition.

OBJECTS OF THE INVENTION

Accordingly, it is a general object of the present invention to avoid the disadvantages of the prior art.

More particularly, it is an object of the present invention to provide an arrangement for attaching holiday decorations to various external structural features of a building, which arrangement does not possess the drawbacks of the known arrangements of this kind.

Still another object of the present invention is to devise a decoration mounting arrangement of the type here under consideration that is universally usable for attaching such decorations to a multitude of potential external supports that can be found on a variety of buildings.

It is yet another object of the present invention to design the above arrangement in such a manner as to be employable without inflicting undesirable damage to any of the structures on which it may be mounted.

A concomitant object of the present invention is so to construct the arrangement of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an arrangement for mounting decorative lights on a variety of external building structures. This mounting arrangement includes a mounting member having a support portion extending along a plane and including at least one substantially cylindrical confining portion for receiving a portion of the respective decorative light. The mounting member further includes a mounting portion including a central portion extending substantially along the aforementioned plane, and a pair of angled lateral portions flanking the central portion and extending out of the plane and back to it, as considered in a direction away from the support portion. The central portion and the pair of lateral portions are operative for engaging oppositely facing surfaces of the respective building structure to at least frictionally detain the mounting member and, thus, the miniature light in place on the building structure.

Advantageously, the central portion includes a detent rising out of the above-mentioned plane in direction toward the lateral portion and the support portion. This improves the security of detention of the mounting member on the building structure. Along these same lines, it is further advantageous when the detent is provided at its free end face with a series of serrations for digging into the respective building structure.

When the building structure is a roof shingle, the detent projects out of the plane to a considerable extent to engage the roof shingle from underneath. In this case, it is further advantageous when each of the lateral portions has a tooth projecting from the respective lateral portion toward the respective shingle, and/or when the teeth of the lateral portions are situated to the two sides of the detent at most at a small spacing therefrom as considered in the longitudinal direction of the central portion and project to such an extent towards the detent as to force the roof shingle to follow a tortuous path as it passes between the teeth and the detent.

The mounting arrangement of the present invention is also intended for mounting on a soffit constituting the aforementioned building structure. In this case, it is advantageous for each of the lateral portions to include a tooth that projects from a region thereof that faces toward the central portion and is positioned to dig into the soffit when the arrangement is mounted thereon.

On the other hand, when the arrangement is to be mounted on a vinyl gutter which has a ledge, each of the lateral portions is again provided with a tooth that projects from a region thereof that faces toward the central portion and is positioned to engage behind the ledge when the arrangement is mounted on the gutter.

Last but not least, when the arrangement is to be supported, as also contemplated, on a metal gutter having a curled edge portion including at least a rear protuberance, each of the lateral portions is once more provided with a tooth that projects from a region thereof that faces toward the central portion and is positioned to engage behind the rear protuberance when the arrangement is mounted on the gutter. In this case, the aforementioned detent also plays an important role, especially when the curled edge portion of the metal gutter further includes a front protuberance, in that it extends from the support portion into engagement with the front protuberance when the arrangement is mounted on the gutter.

According to another facet of the present invention, the mounting portion additionally includes a connecting portion that connects the lateral portions with one another. This connecting portion may advantageously be provided with an upturned lip for engagement and displacement of the lateral portions away from the central portion in the process of dismounting the arrangement from the building structure. It is also advantageous when the connecting portion is provided, at a region thereof that is to come into contact with the respective building structure, with serrations operative for positively engaging the building structure at that particular location.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
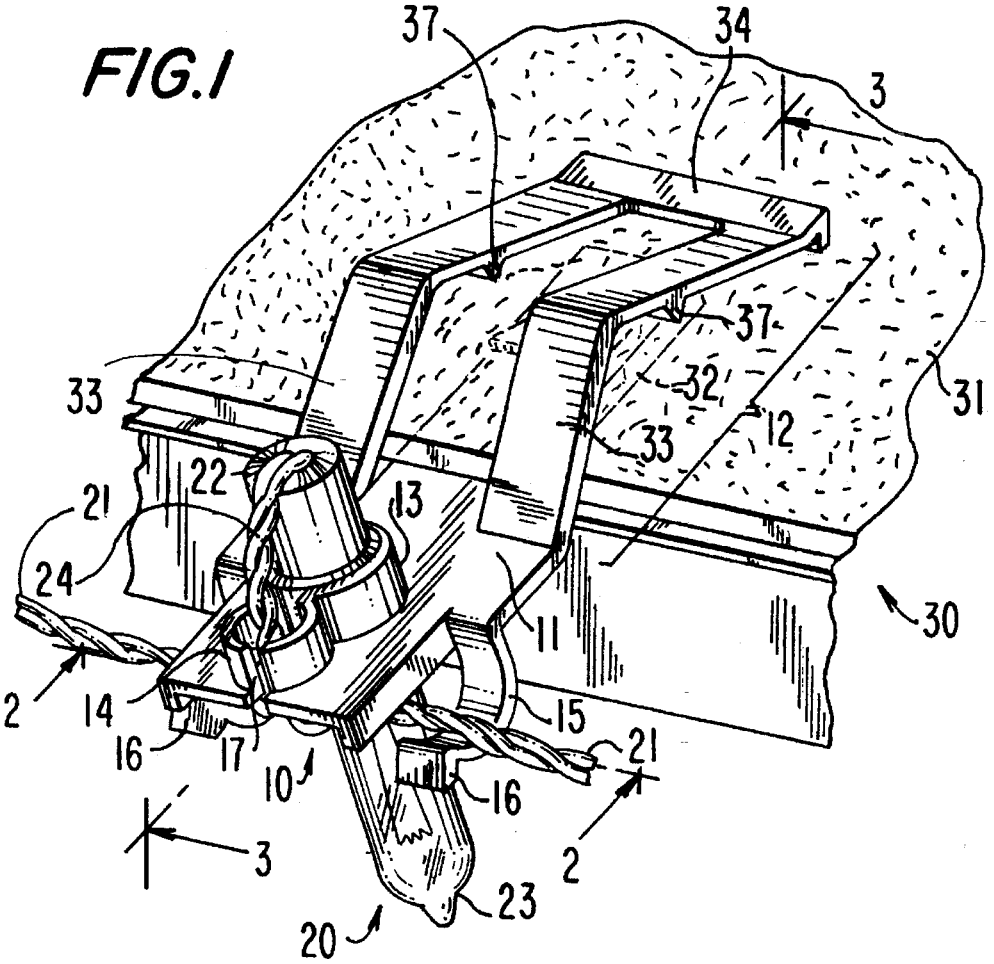
FIG. 1 is a perspective view of a mounting arrangement of the present invention as used to attach a miniature light that constitutes one member of a chain of such lights to a shingle located at the edge of a roof.

Referring now to the drawing in detail, and first to FIG. 1 thereof, it may be seen that the reference numeral 10 has been used therein to identify a mounting arrangement of the present invention in its entirety. As illustrated, the mounting arrangement 10 is constructed as a universal bracket for supporting a single miniature light 20 of a set or chain of such lights, as well as wiring 21 associated with such light 20 or light set, on a variety of support structures. Consequently, the mounting arrangement 10 is provided with a plurality of formations or portions not all of which have utility in each mounting application but each of which finds its use in at least one such mounting application.

FIG. 1 of the drawing shows that the mounting arrangement or bracket 10 includes a support portion 11 and an attaching portion collectively indicated at 12. As a comparison of FIGS. 1 and 2 will reveal, the support portion 11 includes an integral substantially tubular confining portion 13, and an adjacent additional substantially tubular confining portion 14. In the illustrated example, the confining portion 13 confines and actually grips a socket portion 22 of the miniature light 20 to hold the latter in position, with a lamp portion or bulb 23 of the light 20 extending generally downwardly from the support portion 11. At this juncture, it is to be pointed out that all references used herein with respect to directions or relative positions of various components are to be understood to be related exclusively with respect to the orientation(s) shown in the drawing and have no other significance whatsoever. Thus, for instance, the miniature light could be mounted on the support portion 11 in an inverted position, that is with the bulb 23 pointing up, if so desired or preferred.

Figure 2:
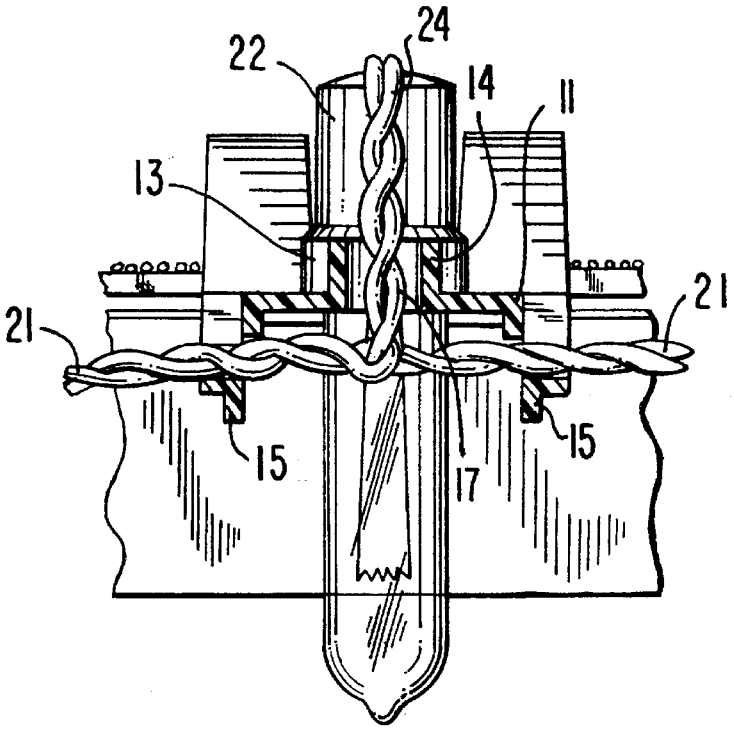
FIG. 2 is a cross-sectional view of the inventive mounting arrangement taken on line 2—2 of FIG. 1.

In the situation illustrated in FIGS. 1 and 2, a twisted wire pair 24 constituting a part of the wiring 21 emerges from the upper face of the socket part 22 and extends downwardly therefrom to join the remainder of the wiring 21. As shown, this wire pair 24 passes through the additional confining member 14 and is confined therein against excessive transverse movements when subjected to high winds or wind gusts, for instance. For a similar reason, the support portion 11 of the mounting arrangement 10 is provided with means for keeping that portion of the wiring 21 which is juxtaposed with the mounting arrangement 10 in place relative to the arrangement 10. Such means is shown to include a pair of generally trough-shaped support brackets 15, one on each side of the support portion 11. Each of the brackets 15 is provided with a downturned engaging end portion 16 that can be easily gripped by a user or installer of the arrangement 10 or of the light chain or set to deflect the respective bracket 15 downwardly out of the way of introduction of the wiring 21 into the space bounded by the bracket 15 from below and by the support portion 11 from above, or its withdrawal from such space. It will become clearer later on that the distance between the region of merger of the end portion 16 with the remainder of the bracket 15 is spaced from the support bracket 11 in an undeflected condition by less than the transverse dimension of the wiring 21 so that such wiring 21 cannot fall out of or be otherwise accidentally or inadvertently removed from the aforementioned space in the absence of deliberate deflection of the bracket 15.

It may also be seen especially in FIG. 1 of the drawing that both of the confining members 13 and 14 are constructed as split sleeves in that there is provided a slot 17 that bisects them as well as the regions of the support portion that extend between the confining members 13 and 14 and between the latter and the adjacent edge of the support member. This slot 17 serves a dual purpose: for one, it permits the two parts of the respective split sleeve 13 or 14 to resiliently move apart and together, for instance as the socket part 22 of the miniature light 20 is being axially pushed into the split sleeve 13 in the illustrated situation to achieve the requisite gripping action or frictional detention. On the other hand, the presence of the slot 17 also renders it possible to introduce the twisted wire pair 24 through it into the additional confining member 14, a task that would be impossible to achieve in the absence of such slot 17 without totally disassembling the light 20.

Furthermore, the confining members 13 and 14 make the arrangement 10 universal in more senses than one in that the mounting arrangement 10 can also be used for a different type of miniature light set in which the outer diameter of the socket part 22 is smaller and only slightly exceeds the internal diameter of the additional confining member 14. In that case, the twisted wire pair 24 is introduced through the slot 17 into the confining member 13 first, followed by the axial insertion of the aforementioned smaller-diameter socket part 22 into the additional confining member 14 with attendant slight pushing of the two parts of the confining member 14 apart.

A commercially available large light 20 is insertable into, and frictionally held in, the confining member 13 which advantageously has an internal diameter on the order of 0.424 inches, while a different, smaller commercially available light is insertable into, and frictionally held in, the confining member 14 which advantageously has an internal diameter on the order of 0.290 inches. Thus, both larger and smaller lights can be selectively, either individually or simultaneously, accommodated on the same bracket 10.

Figure 3:
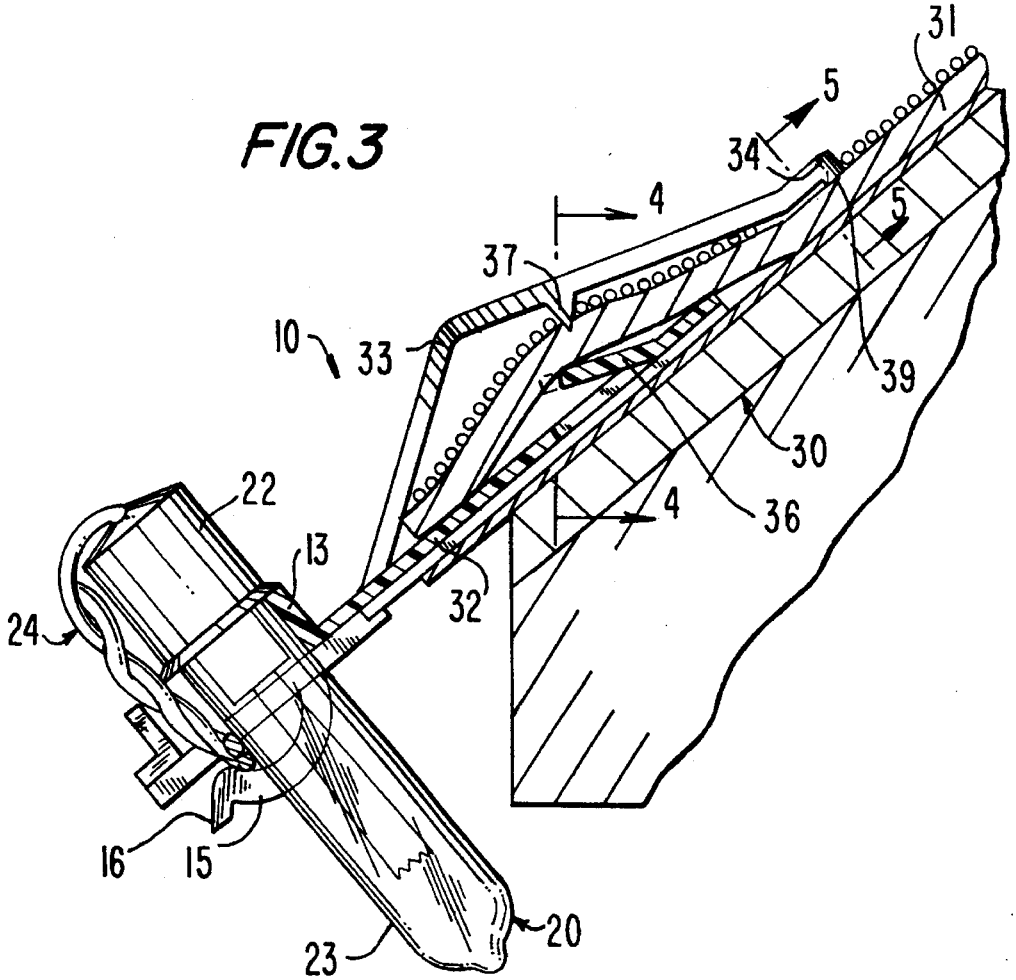
FIG. 3 is a longitudinal sectional view of the inventive mounting arrangement taken on line 3—3 of FIG. 1.
Figure 5:
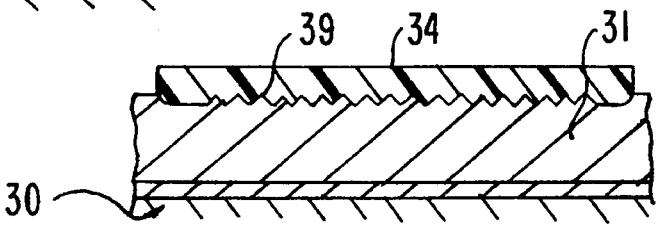
FIG. 5 is a cross-sectional view akin to that of FIG. 4, but taken on line 5—5 of FIG. 3.

As may be ascertained from observing FIGS. 1 and 3 in conjunction with one another, the mounting member 10 is constructed for use, in one instance, at the edge of a roof 30 that is covered by water-impermeable flexible elements 31, such as roof shingles. In this instance, the attaching or mounting portion collectively indicated at 12 is designed to firmly engage the marginal portion of the lowermost shingle 31 both from above and from below. To achieve this, the mounting portion 12 is subdivided into a substantially planar central portion 32 that is shown to constitute an integral co-planar continuation of the support portion 11, and a pair of angled lateral portions 33 flanking the central portion 32 and bent out of the plane thereof and back. As shown in FIG. 1, the regions of the lateral portions 33 that are remote from the support portion 11 are interconnected by an integral transverse connecting portion 34 which, as shown in FIG. 5, is provided with a series of serrations 39.

The mounting portion 12, together with the remainder of the mounting arrangement 10, is made of a material exhibiting a relatively high resiliency. While various metals may be suited for this purpose, certain synthetic plastic materials, especially one commercially available under the designation ABS, are ideal candidates for this use. Because of such inherent resiliency and the positioning of the connecting portion 34 substantially in, or even beyond, the plane of the central portion 32 in a relaxed state of the mounting portion 12 assumed prior to assembly with the shingle 31, the lateral and interconnecting portions 33 and 34, on the one hand, and the support portion 32, on the other hand, pinch the lower marginal portion of the shingle 31 between themselves.

This pinching action and the attendant frictional forces acting between the shingle 31 and the mounting portion 12 after the installation of the mounting arrangement 10 in the position apparent in FIG. 1 may already be sufficient for inhibiting dissociation of the arrangement 10 from the shingle 31. However, to provide additional assurance against the occurrence of such an event, the central portion 32 is shown to be provided with a rearwardly rising tab or detent 36 that progressively digs into the shingle 31 with advancing downward sliding of the arrangement 10 until any movement is stopped after the arrangement 10 has traveled only a minuscule distance. A downwardly pointing protuberance or tooth 37 on each of the lateral portions 33 provides an additional inhibitor of such movement by digging into the shingle 31 from above. The digging-in action is enhanced by providing a series of serrations 66 on each tooth 37.

Figure 4:
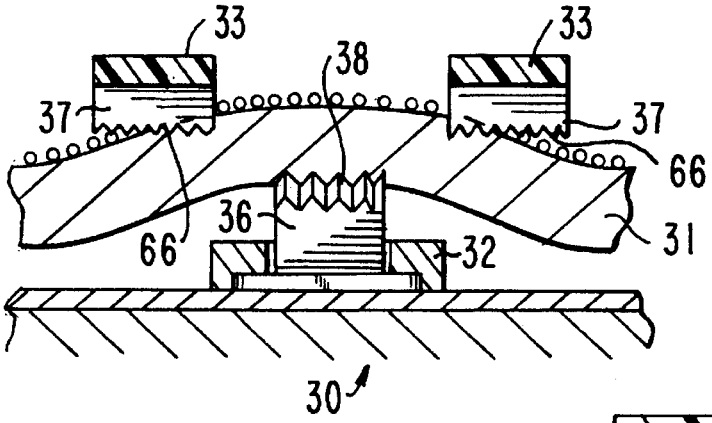
FIG. 4 is another cross-sectional view, but at an enlarged scale, and taken on line 4—4 of FIG. 3.

As shown in FIG. 4 of the drawing, the detent 36 is situated substantially midway between the teeth 37 and is provided with a series of serrations 38 at its free end for further enhancing the aforementioned digging-in action. It may also be seen there that the detent 36 and the teeth 37 are so positioned relative to one another that the shingle 31 is forced to buckle as it passes between them. This further enhances the detaining action of the serrations 38 and of the serrations 66 on the teeth 37.

As previously noted and shown in FIG. 5 of the drawing, the connecting portion 34 is provided with the series of serrations 39 that engage the shingle 31 at this location and thus further improve the retention of the mounting arrangement 10 on the shingle 31. Of course, despite this secure attachment to the shingle 31, the removal of the arrangement 10 from the shingle 31 is a relatively easy task in that the user simply engages the connecting portion, which may be provided for this purpose with an upturned lip, and lifts the upper part of the mounting portion 12, that is the combination of the lateral portions 33 with the connecting portion 34. This lifting movement dissociates the serrations 39 and the teeth 37 from the shingle 31 and also permits the shingle 31 to yield out of the paths of travel of the serrations 38 of the detent 36 as the central portion 32 is being withdrawn from between the shingle 31 and the roof 30 proper.

Figure 6:
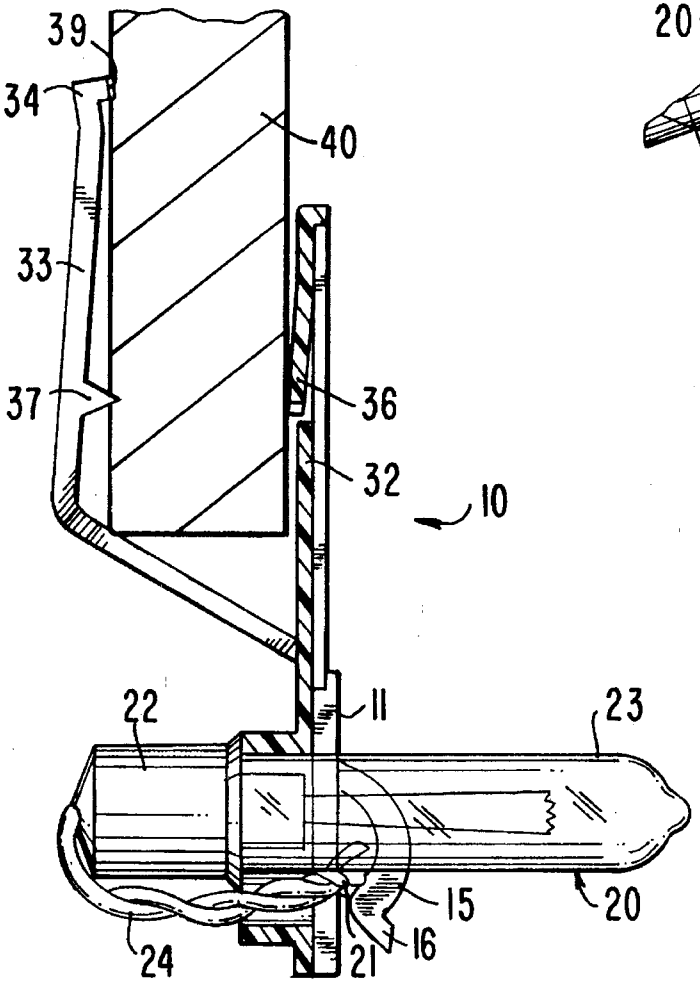
FIG. 6 is a sectional view corresponding to that of FIG. 2, but showing the mounting arrangement as used to connect the miniature light to a soffit.

It has been mentioned before that the mounting arrangement 10 is designed for multiple or universal applications. In view of this desired goal, the various features and/or portions of the mounting portion 12 are strategically distributed to cooperate with corresponding features or formations of counterparts other than shingles. Thus, for instance, it may be seen in FIG. 6 of the drawing that the central portion 32 and the lateral and connecting portions 33 and 34 can be placed in juxtaposition with opposite major surfaces of a vertical soffit 40. In this case, the portions 32 and 33 are spaced much farther apart than in the previously discussed case, so that the forces acting between them and the soffit 40 greatly exceed those encountered before and rise to a level that in many instances would be sufficient to prevent the arrangement 10 from sliding down and off the soffit 40. Yet, the teeth 37 and the detent 36 as well as the serrations 39, due to their locations on the respective associated portions 32 and 33, provide further assurance against such sliding by pressing against and/or into the usually relatively soft material of the soffit 30. What is also visible in FIG. 6 is that the arcuate bracket 15 is indeed so configured as not to let the wiring 21 slide out of the space between it and the support portion 11 even in this situation in which the gap between the two members 15 and 11 is situated at the bottom of such space, due to the relative narrowness of such gap relative to the diameter of the wiring 21.

Figure 7:
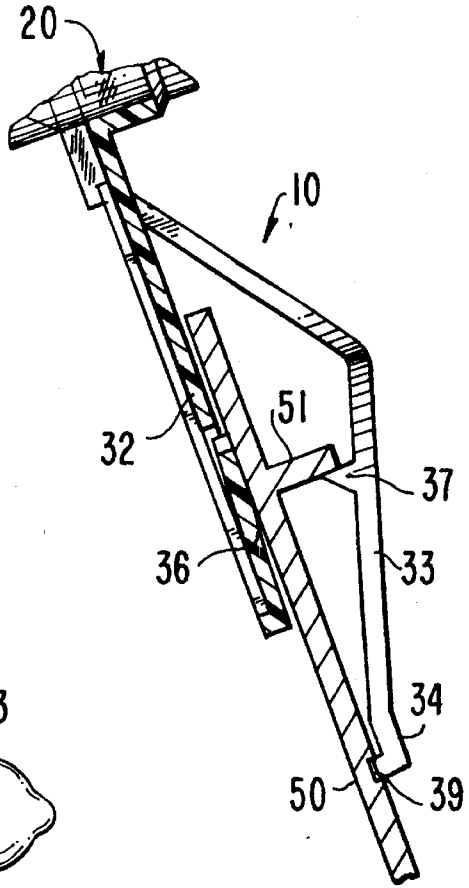
FIG. 7 is a view similar to that of FIG. 6, but with the mounting arrangement being supported on a vinyl gutter.

A further application of the universal mounting arrangement 10 is shown in FIG. 7 of the drawing. In this case, the mounting arrangement is being used in conjunction with a gutter 50 that is made of vinyl or similar synthetic plastic material. The frontwardly facing portion of such a gutter 50 is customarily provided with a ledge 51 the usual utility of which is to support a free edge of a mesh structure that is intended to prevent leaves and other debris from falling into the gutter 50 while not interfering with the flow of water from the roof into the gutter 50. In the illustrated case, however, the projecting ledge 51 serves to detain the mounting arrangement 10 on the gutter 50 in that the correspondingly situated teeth 37 of the lateral portions 33 engage behind it. Additional engagement, albeit not as pronounced, is again provided by the detent 36 and the serrations 39 of the connecting portion 34.

Figure 8:
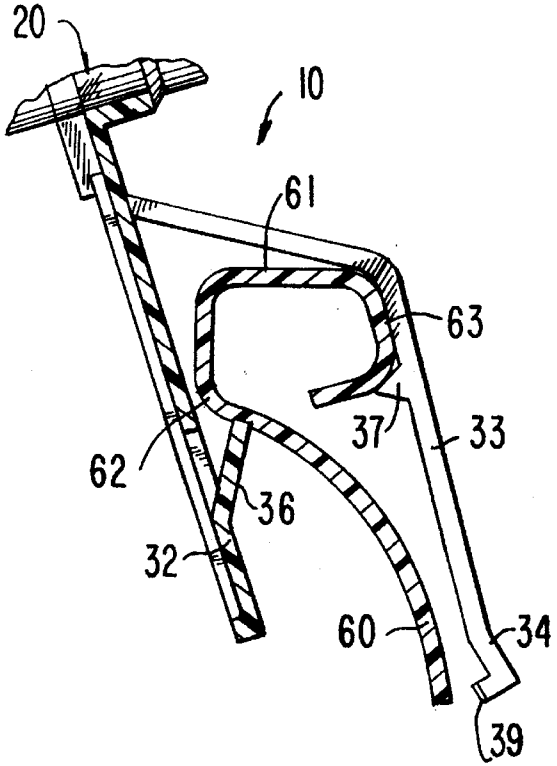
FIG. 8 is a view like that of FIG. 7, but with the mounting arrangement being mounted this time on an aluminum gutter.

Last but not least, the universal mounting arrangement 10 is also designed for cooperation with metal, especially aluminum, gutters 60, in a manner illustrated in FIG. 8 of the drawing. In this case, the gutter 60 does not have the aforementioned ledge 51; rather, an upper portion 61 of the front side of such gutter 60 is curled back on itself, thus presenting a hollow front protuberance 62 and a hollow rear protuberance 63. In this application, the teeth 37 of the lateral portions 33, which again are properly positioned by design for this purpose, engage behind the rear protuberance 63, whereas the detent 36 of the central portion 32, and especially its serrations 38 engage the front protuberance 62 from below. Here again, like in all other cases described above, there is obtained a secure attachment of the mounting arrangement 10 to the underlying structure, in this case the aluminum gutter 60.

It will be understood that each of the elements described above, or two or more together, may also find a useful application in other types of constructions differing from the type described above.

While the present invention has been described and illustrated herein as embodied in a specific construction of an universal arrangement for mounting decorative lights on various structures associated with a roof of a building, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A mounting member for mounting a plurality of decorative lights interconnected by wires on a variety of external building structures, comprising:

a support portion extending along a plane and including at least one substantially cylindrical confining portion for receiving a portion of the respective decorative light, and a pair of trough-shaped portions flanking said one substantially cylindrical confining portion and operative for receiving and supporting the wires connected to and extending from opposite sides of the respective decorative light, said confining portion being open onto a peripheral edge of the support portion at a region between the trough-shaped portions, and a mounting portion including a central portion extending substantially along said plane, and a pair of angled lateral portions flanking said central portion and extending out of said plane and back to it as considered in a direction away from said support portion, said central portion and said pair of lateral portions being operative for engaging oppositely facing surfaces of the respective building structure to at least frictionally detain said mounting member and thus the respective decorative light in place on the respective building structure.

2. The mounting member as defined in claim 1, wherein said central portion includes a detent rising out of said plane in a direction toward said lateral portion and said support portion.

3. The mounting member as defined in claim 2, wherein said detent has a free end face provided with a series of serrations for digging into the respective building structure.

4. The mounting member as defined in claim 2, wherein said detent projects out of said plane to a considerable extent to engage the building structure from underneath.

5. The mounting member as defined in claim 4, wherein each of said lateral portions has a tooth projecting from the respective lateral portion toward the building structure.

6. The mounting member as defined in claim 5, wherein said teeth of said lateral portions are situated to the two sides of said detent at most at a small spacing therefrom as considered in the longitudinal direction of said central portion and project to such an extent towards said detent as to force the building structure to follow a tortuous path as it passes between said teeth and said detent.

7. The mounting member as defined in claim 6, wherein each tooth is provided with a series of serrations.

8. The mounting member as defined in claim 1, wherein each of said lateral portions includes a tooth that projects from a region thereof that faces toward said central portion and is positioned to dig into the building structure.

9. The mounting member as defined in claim 1, wherein each of said lateral portions includes a tooth that projects from a region thereof that faces toward said central portion and is positioned to engage behind said building structure.

10. The mounting member as defined in claim 1, wherein each of said lateral portions includes a tooth that projects from a region thereof that faces toward said central portion and is positioned to engage behind said building structure.

11. The mounting member as defined in claim 10, wherein said central portion of said mounting portion includes a detent that projects out of said plane toward said lateral portions and said support portion and into engagement with the building structure.

12. The mounting member as defined in claim 1, wherein said mounting portion includes a connecting portion that connects said lateral portions with one another.

13. The mounting member as defined in claim 12, wherein said connecting portion is provided, at a region thereof that is to come into contact with the respective building structure, with serrations operative for positively engaging the building structure at their location.

14. The mounting member as defined in claim 1, wherein said support portion includes another substantially cylindrical confining portion, said confining portions being of different diameter.

15. The mounting member as defined in claim 14, wherein said confining portions open into each other and onto the peripheral edge of said support portion.

* * * * *